US008376066B2

(12) United States Patent
Steele et al.

(10) Patent No.: US 8,376,066 B2
(45) Date of Patent: Feb. 19, 2013

(54) COMBINATION WHIPSTOCK AND COMPLETION DEFLECTOR

(75) Inventors: David Joe Steele, Arlington, TX (US); Aditya Shailesh Deshmukh, Karnataka (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/939,223

(22) Filed: Nov. 4, 2010

(65) Prior Publication Data

US 2012/0111636 A1 May 10, 2012

(51) Int. Cl.
*E21B 7/08* (2006.01)
*E21B 7/04* (2006.01)

(52) U.S. Cl. ..... 175/61; 166/50; 166/313; 166/117.5; 166/169

(58) Field of Classification Search ..... 166/50, 166/117.5, 117.6, 169, 313; 175/61, 62
See application file for complete search history.

(56) References Cited

U.S. PATENT DOCUMENTS

| | | | | | |
|---|---|---|---|---|---|
| 4,440,218 | A | * | 4/1984 | Farley | 166/51 |
| 5,115,872 | A | * | 5/1992 | Brunet et al. | 175/61 |
| 5,301,760 | A | * | 4/1994 | Graham | 175/61 |
| 5,318,121 | A | * | 6/1994 | Brockman et al. | 166/313 |
| 5,318,122 | A | * | 6/1994 | Murray et al. | 166/313 |
| 5,322,127 | A | * | 6/1994 | McNair et al. | 166/313 |
| 5,325,924 | A | * | 7/1994 | Bangert et al. | 166/313 |
| 5,353,876 | A | * | 10/1994 | Curington et al. | 166/313 |
| 5,388,648 | A | * | 2/1995 | Jordan, Jr. | 166/380 |
| 5,425,419 | A | * | 6/1995 | Sieber | 166/206 |
| 5,458,209 | A | * | 10/1995 | Hayes et al. | 175/61 |
| 5,467,819 | A | * | 11/1995 | Braddick | 166/117.6 |
| 5,474,126 | A | * | 12/1995 | Lynde et al. | 166/117.6 |
| 5,520,252 | A | * | 5/1996 | McNair | 166/313 |
| 5,533,573 | A | * | 7/1996 | Jordan et al. | 166/313 |
| 5,787,978 | A | * | 8/1998 | Carter et al. | 166/117.6 |
| 5,971,074 | A | * | 10/1999 | Longbottom et al. | 166/313 |
| 6,019,173 | A | * | 2/2000 | Saurer et al. | 166/98 |
| 6,076,602 | A | * | 6/2000 | Gano et al. | 166/298 |
| 6,092,602 | A | * | 7/2000 | Gano | 166/313 |
| 6,116,344 | A | * | 9/2000 | Longbottom et al. | 166/298 |
| 6,334,487 | B1 | * | 1/2002 | Adkins et al. | 166/55.7 |
| 6,568,480 | B2 | * | 5/2003 | Dewey | 166/382 |
| 6,786,283 | B2 | | 9/2004 | Freeman et al. | |
| 6,915,855 | B2 | | 7/2005 | Steele et al. | |
| 2002/0020562 | A1 | | 2/2002 | Baird | |

(Continued)

FOREIGN PATENT DOCUMENTS

WO WO2009129116 10/2009

OTHER PUBLICATIONS

Oberkircher et al., Apr. 1, 2003, Multilateral Systems for Deep Water Reservoirs, American Association of Drilling Engineers, AADE-03-NTCE-50.*

(Continued)

*Primary Examiner* — Jennifer H Gay
(74) *Attorney, Agent, or Firm* — Kilpatrick Townsend & Stockton LLP

(57) ABSTRACT

Assemblies can be disposed in a subterranean bore. An assembly can include a surface that can divert a cutting tool for creating a branch wellbore and that can divert a completion component for completing the branch wellbore without requiring the assembly or part of the assembly from being removed from a parent wellbore prior to the completion component being diverted.

14 Claims, 6 Drawing Sheets

U.S. PATENT DOCUMENTS

| | | | | |
|---|---|---|---|---|
| 2002/0074120 | A1* | 6/2002 | Scott | 166/313 |
| 2003/0042024 | A1* | 3/2003 | Freeman et al. | 166/313 |
| 2003/0159827 | A1* | 8/2003 | Steele | 166/313 |
| 2004/0149444 | A1* | 8/2004 | Cavender et al. | 166/313 |
| 2004/0159435 | A1* | 8/2004 | Plucheck et al. | 166/313 |
| 2005/0194143 | A1* | 9/2005 | Xu et al. | 166/285 |
| 2006/0000614 | A1* | 1/2006 | Restarick et al. | 166/313 |
| 2006/0131026 | A1* | 6/2006 | Pratt et al. | 166/313 |
| 2007/0034409 | A1* | 2/2007 | Dale et al. | 175/61 |
| 2007/0089875 | A1* | 4/2007 | Steele et al. | 166/50 |
| 2007/0221380 | A1* | 9/2007 | Restarick et al. | 166/313 |
| 2008/0029276 | A1* | 2/2008 | Templeton et al. | 166/385 |
| 2008/0296029 | A1 | 12/2008 | Ortiz | |
| 2009/0008078 | A1* | 1/2009 | Patel | 166/50 |
| 2009/0151950 | A1* | 6/2009 | Patel | 166/298 |
| 2009/0255661 | A1 | 10/2009 | Clark et al. | |
| 2009/0255664 | A1* | 10/2009 | Hart et al. | 166/117.6 |
| 2009/0266559 | A1* | 10/2009 | Horvath et al. | 166/382 |
| 2010/0212913 | A1 | 8/2010 | Renshaw et al. | |

OTHER PUBLICATIONS

Non-Final Office Action for U.S. Appl. No. 12/389,433, mailed Dec. 8, 2010 (9 pages).

Response to Office Action for U.S. Appl. No. 12/389,433, filed Mar. 7, 2011 (18 Pages).

Non-Final Office Action for U.S. Appl. No. 12/389,433, mailed Apr. 6, 2011 (11 pages).

Response to Office Action for U.S. Appl. No. 12/289,433, filed Jul. 5, 2011 (12 pages).

Notice of Allowance for U.S. Appl. No. 12/389,433, mailed Sep. 6, 2011 (7 pages).

PCT Application No. PCT/US2011/058905, International Search Report and Written Opinion mailed Jun. 19, 2012 (12 pages).

PCT Application No. PCT/US2011/058905, Partial Search Report mailed May 2, 2012 (7 pages).

* cited by examiner

COMBINATION WHIPSTOCK AND COMPLETION DEFLECTOR

TECHNICAL FIELD OF THE INVENTION

The present invention relates generally to an assembly for subterranean fluid production and, more particularly (although not necessarily exclusively), to an assembly that includes a surface that can divert a cutting tool for creating a branch wellbore and can divert at least part of a component for completing the branch wellbore.

BACKGROUND

Hydrocarbons can be produced through a wellbore traversing a subterranean formation. The wellbore may be relatively complex. For example, the wellbore can include branch wellbores, such as lateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first direction and a secondary wellbore diverted from the main wellbore and in a second general direction.

A parent wellbore can include a window to allow branch wellbores to be formed. A window can be formed by positioning a casing joint and a whipstock in a casing string at a desired location in the main wellbore. The whipstock can deflect one or more mills (or other cutting tools) laterally (or in one or more various orientations) relative to the casing string. The deflected mills penetrate part of the casing joint to form the window in the casing string through which drill bits can form the lateral wellbore.

The whipstock can include a retrieval mechanism that permits the whipstock to be removed from the parent wellbore after the branch wellbore is formed. After the whipstock is removed, a completion deflector is run to a desired location with respect to the window. The completion deflector can include an opening that can receive part of a junction, such as a seal stinger of a mainbore leg, and can include a deflective surface that can deflect the other part of the junction toward the window and branch wellbore. The junction or other components can be used to complete the branch wellbore. Retrieving the whipstock and running the completion deflector increases the number of trips downhole and, thus, increases the inefficiency and expense of operating a production well.

Some assemblies have been used to eliminate the need for two trips to run a whipstock and a completion deflector. For example, an assembly can include a whipstock that is detachably connected to a completion deflector. The assembly is run downhole for installation. The whipstock can divert a milling bit for forming a window through which a lateral wellbore can be created. The whipstock is retrieved, after the lateral wellbore is created, by detaching it from the completion deflector. After the whipstock is retrieved, components can be run into the wellbore and can be diverted by the completion deflector for completing the lateral wellbore. The assembly, however, requires a trip to retrieve the whipstock before a lateral wellbore can be completed. The trip can increase expense and decrease efficiency of well completion.

Accordingly, assemblies are desirable that can divert a cutting tool and a completion component such as a junction, but do not require a trip to retrieve a whipstock prior to deflecting a completion component.

SUMMARY

In one aspect, an assembly capable of being disposed in a wellbore is provided. The assembly includes a surface on an outer wall of a body. The surface can divert a cutting tool for forming a branch wellbore. The surface can also divert at least part of a completion component toward the branch wellbore. The completion component can be used to complete the branch wellbore.

In at least one embodiment, the surface on the outer wall is a whipstock deflection surface and a completion deflector surface.

In at least one embodiment, the completion component is a junction that has a stinger and a lateral leg. The surface can receive the stinger and can deflect the lateral leg toward the branch wellbore.

In at least one embodiment, the assembly includes a temporary plugging subsystem between the surface and a channel capable of receiving the stinger.

In at least one embodiment, the temporary plugging subsystem includes at least one of a frangible plug, a removable plug, a frangible flapper valve, a flapper valve, a removable screen, or a diaphragm.

In at least one embodiment, the assembly includes a liner that can be displaced by the stinger. The liner can prevent at least some debris from contacting a sealing member.

In at least one embodiment, the liner includes a coupling component that can secure the liner at a first position and, responsive to a force from the stinger, secure the liner at a second position.

In at least one embodiment, the coupling component can releasably secure the liner at the second position. The coupling component can include at least one of at least one collet that is capable of cooperating with a collet profile, or a snap ring.

In at least one embodiment, the assembly includes a latch member coupled to the body through a body portion. The latch member can couple to another component disposed in the wellbore.

In at least one embodiment, the surface can divert the cutting tool and can divert at least part of the completion component without requiring part of the assembly to be removed from the wellbore prior to diverting the completion component.

In another aspect, a method is provided for forming and completing a branch wellbore. An assembly is disposed in a parent wellbore. The assembly includes a surface on an outer wall of the assembly. A cutting tool is moved to the surface on the outer wall of the assembly at which the surface on the outer wall of the assembly deflects the cutting tool toward a sidewall of a casing string. The cutting tool can form the branch wellbore after being deflected toward the sidewall of the casing string. The cutting tool is removed from the branch wellbore without removing the assembly. A completion component is moved to the surface on the outer wall of the assembly at which the surface on the outer wall of the assembly deflects at least part of the completion component toward the branch wellbore. The deflected completion component can be used to complete the branch wellbore.

In at least one embodiment, the completion component is a junction that includes a stinger and a lateral leg. Moving the completion component to the surface on the outer wall of the assembly includes moving the junction to cause the surface to deflect the lateral leg toward the branch wellbore and to cause the assembly to receive the stinger.

In at least one embodiment, moving the junction to cause the surface to deflect the lateral leg toward the branch wellbore and to cause the assembly to receive the stinger includes moving the junction to cause a breaker associated with the stinger to break a temporary plugging subsystem of the assembly and to be received by a channel of the assembly. The stinger displaces at least part of a liner that can protect at least one component from debris.

In at least one embodiment, the branch wellbore is completed without removing from the parent wellbore the surface on the outer wall of the assembly for deflecting the cutting tool.

In another aspect, an assembly capable of being disposed in a wellbore is provided. The assembly includes a body and a liner. The body has a surface. The surface can divert a cutting tool toward a sidewall of a casing string and can divert at least part of a completion component toward a branch wellbore. The cutting tool can create the branch wellbore. The completion component can be used to complete the branch wellbore. The liner can protect at least one component from debris and can be displaced by at least part of the completion component.

In at least one embodiment, a first portion of the surface is a whipstock deflection surface and a second portion of the surface is a completion deflector surface.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
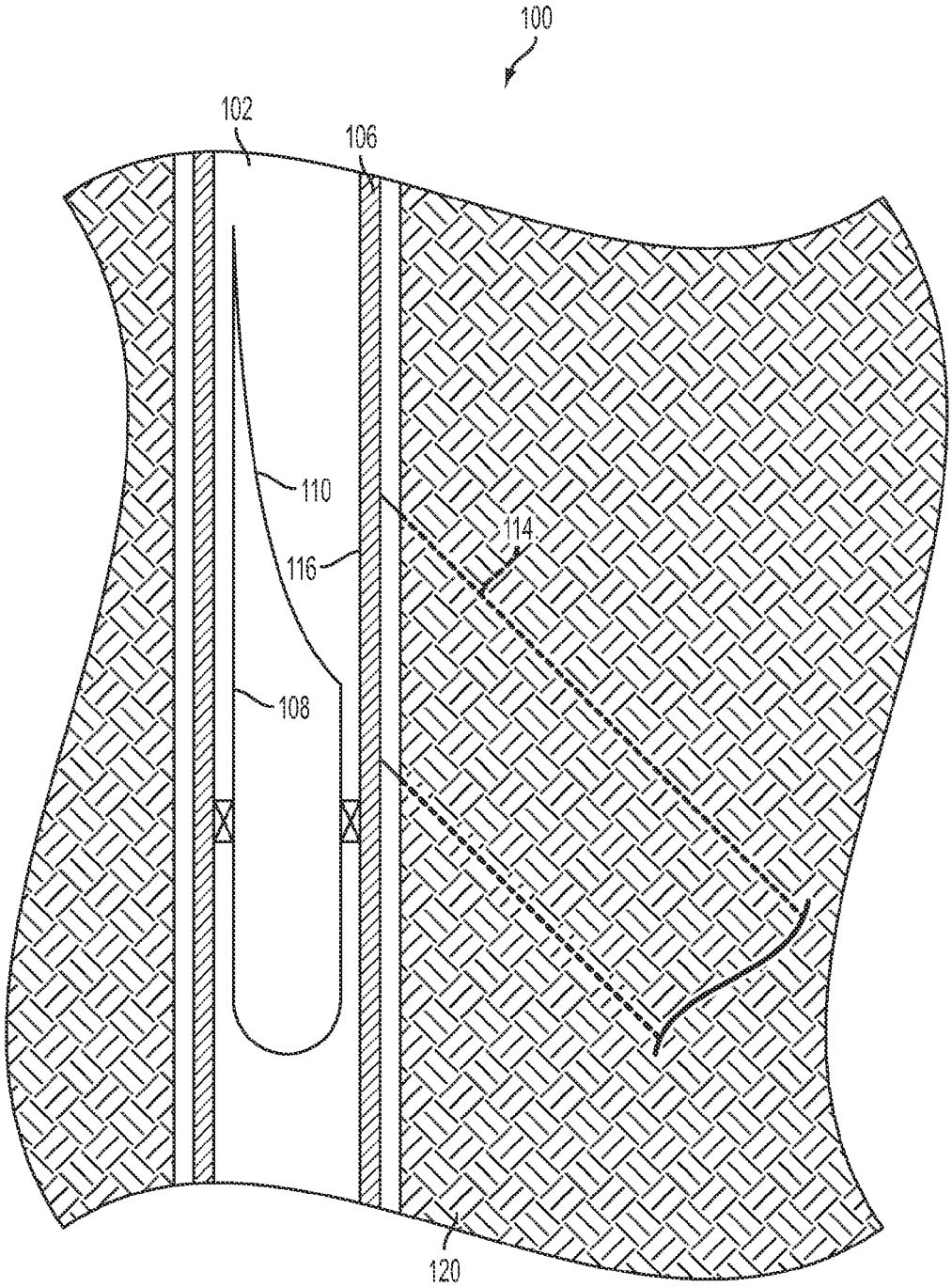
FIG. 1 is a schematic cross-sectional illustration of a well system having an assembly through which a branch wellbore can be created and completed according to one embodiment of the present invention.

Certain aspects and embodiments of the present invention relate to assemblies capable of being disposed in a bore, such as a parent wellbore, of a subterranean formation and with which a branch wellbore can be formed and completed. An assembly according to certain embodiments of the present invention can include a surface on an outer wall that can divert a cutting tool for forming a branch wellbore and can divert at least part of a completion component that is used to complete a branch wellbore.

A "parent wellbore" is a wellbore from which another wellbore is drilled. It is also referred to as a "main wellbore." A parent or main wellbore does not necessarily extend directly from the earth's surface. For example, it can be a branch wellbore of another parent wellbore.

A "branch wellbore" is a wellbore drilled outwardly from its intersection with a parent wellbore. Examples of branch wellbores include a lateral wellbore and a sidetrack wellbore. A branch wellbore can have another branch wellbore drilled outwardly from it such that the first branch wellbore is a parent wellbore to the second branch wellbore.

The surface on the outer wall of the assembly can be a whipstock deflection surface and a completion deflector surface. The assembly can be run downhole and positioned as desired using known positioning techniques. A cutting tool, such as a mill or drill, can be run downhole and deflected by the surface toward a sidewall of a casing string. The cutting tool can form a window completion component can be run downhole. At least part of the completion component can be deflected toward the branch wellbore for completing the branch wellbore. The assembly does not require additional runs to remove (also referred to as "pulling") a whipstock or to position a completion deflector.

The surface may be suitably tapered to allow for milling or drilling out of a window in a casing string, for drilling a lateral leg of a branch wellbore, for deploying a lateral leg of a completion component such as a junction, and for receiving a stinger of the completion component and sealing the stinger. For example, the assembly can include one or more mechanisms for plugging and sealing the main bore. The assembly may also protect against debris that are generated downhole. In some embodiments, the assembly can provide a continuous, sealed flow path to lower completions in the main bore and provide access to intervention through the main bore. The surface can also be recoverable using external and/or internal mechanisms. Examples of external mechanisms include a die collar and an overshot. Examples of internal mechanisms include a running/retrieving tool and a spear. In other embodiments, the surface can divert one stinger and receive a second stinger.

An assembly according to some embodiments can include a whipstock and a completion deflector that are inseparable from each other. The assembly does not require a release mechanism. The assembly can be run into a parent wellbore to a desired location and oriented, using an anchor or other suitable mechanism or method.

Assemblies according to certain embodiments of the present invention can limit the number of trips required to complete a branch wellbore. Limiting the number of trips required to complete the branch wellbore can allow rig operators to realize significant cost savings in operation costs. An assembly according to some embodiments can eliminate trips should a lateral wellbore require cleaning prior to completion. For example, the number of separate trips to remove both completion deflector and drilling whipstock and to re-position each of the completion deflector and drilling whipstock after cleaning can be reduced.

An assembly can also include debris management components that are capable of preventing at least some debris generated in branch wellbore creation and completion from affecting other components located below the branch wellbore. The debris management components can include a liner and a temporary plugging subsystem. The liner can include a coupling component, such as a collet, and can subsequently allow the liner to be shifted downward, away from the surface, from a first position to a second position. For example, the coupling component can be a collet and the debris management components can also include a second collet profile located below a first collet profile. The second collet profile can retain the liner subsequent to its downward shift. In some embodiments, the coupling component can releasably secure the liner at the second position. The liner can be made from any suitable material, such as steel. The temporary plugging subsystem may be a frangible plug, removable plug, frangible flapper valve, flapper valve, removable screen, diaphragm, or a combination of these or other devices.

The temporary plugging subsystem can be capable of preventing cuttings from reaching the collets. The temporary plugging subsystem may be made from a material, such as ceramic, that can break easily upon contact with a stinger of a completion component or other similar component. A running tool can be included that allows the assembly to be run downhole.

The debris management components can allow debris to be flushed out until a stinger of a completion component contacts the temporary plugging subsystem at a top end of the debris management components. In some embodiments, the stinger contacting the temporary plugging subsystem can cause the liner to be repositioned downward to the second position to provide a seal for components below the junction.

In some embodiments, a completion tool can be configured to cooperate with an assembly to provide desired performance. For example, the completion tool can be a junction that includes a stinger and a lateral leg. The stinger can be a main bore leg that is capable of being received through the surface of an assembly. A breaker can be associated with the stinger and can be configured to break a temporary plugging subsystem of an assembly. The breaker can be received into a sleeve that has a coupling component. The stinger pushes the sleeve down until the sleeve is at a second position. In some embodiments, after the junction is landed, a running tool, such as a liner hanger running tool, used to run the assembly downhole is removed from the wellbore, along with the breaker. The breaker can be coupled to the running tool via tubing to allow fluid to be pumped from the surface through the running tool and the breaker when "stabbing" the breaker and stinger into the bore. The fluid can allow debris to be flushed out of the bore and off the top of the temporary pluging subsystem.

These illustrative examples are given to introduce the reader to the general subject matter discussed here and are not intended to limit the scope of the disclosed concepts. The following sections describe various additional embodiments and examples, with reference to the drawings in which like numerals indicate like elements and directional descriptions are used to describe the illustrative embodiments but, like the illustrative embodiments, should not be used to limit the present invention.

FIG. 1 shows a well system 100 with an assembly according to one embodiment of the present invention. The well system 100 includes a parent wellbore 102 that extends through various earth strata. The parent wellbore 102 includes a casing string 106 cemented at a portion of the parent wellbore 102.

The assembly 108 can be disposed in an inner region defined by the casing string 106. The assembly 108 can be positioned at a desired location to form a branch wellbore 114 from the parent wellbore 102, and to complete the branch wellbore 114. The desired location can be an intersection 116 between the parent wellbore 102 and the branch wellbore 114. The assembly 108 can be positioned using various techniques. Examples of positioning techniques include using a gyroscope and using an orienting profile.

Branch wellbore 114 is depicted with dotted lines to indicate that it has not yet formed. To form the branch wellbore 114, one or more cutting tools, such as mills and drills, are lowered through the casing string 106 and are deflected by a surface 110 of the assembly 108 toward a sidewall of the casing string 106. The cutting tools mill through the sidewall of the casing string 106 to form a window through which the cutting tools can create branch wellbore 114 in the subterranean formation adjacent to the window.

Figure 7:
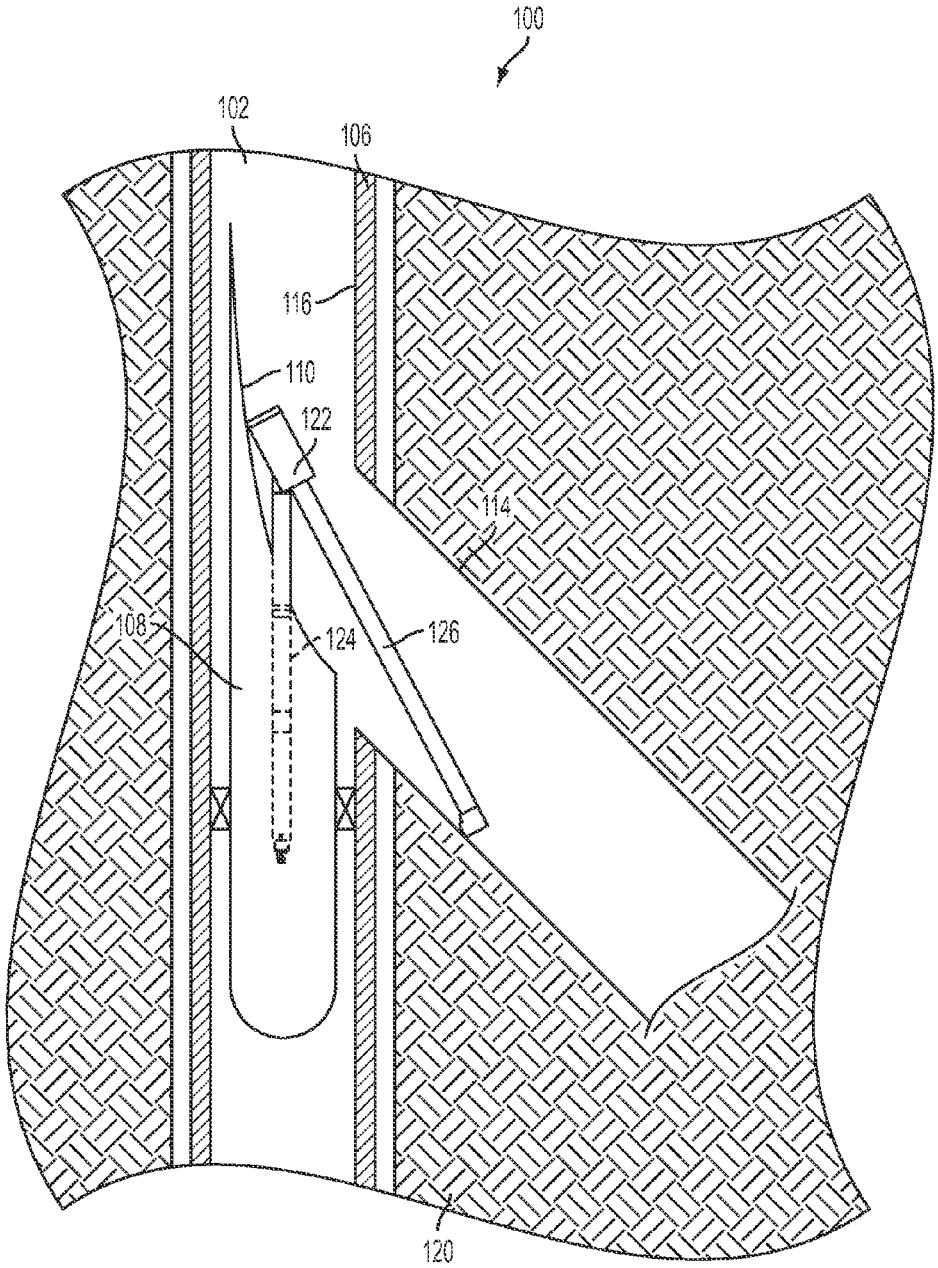
FIG. 7 is a schematic cross-section illustration of the well system of FIG. 1 that includes a completion component that is a joint according to one embodiment of the present invention.

The cutting tools can be removed from the branch wellbore, a completion component can be lowered through the casing string 106, and at least part of the completion component can be deflected by the surface 110 of the assembly 108 toward the branch wellbore 114 to complete the branch wellbore 114. For example and as shown in FIG. 7, the completion component may be a junction 122 that includes a stinger 124 (also referred to as a main bore leg) and a lateral leg 126. The surface 110 of the assembly 108 can deflect the lateral leg 126 toward the branch wellbore 114 and receive the stinger 124 through an opening or otherwise.

Figure 2:
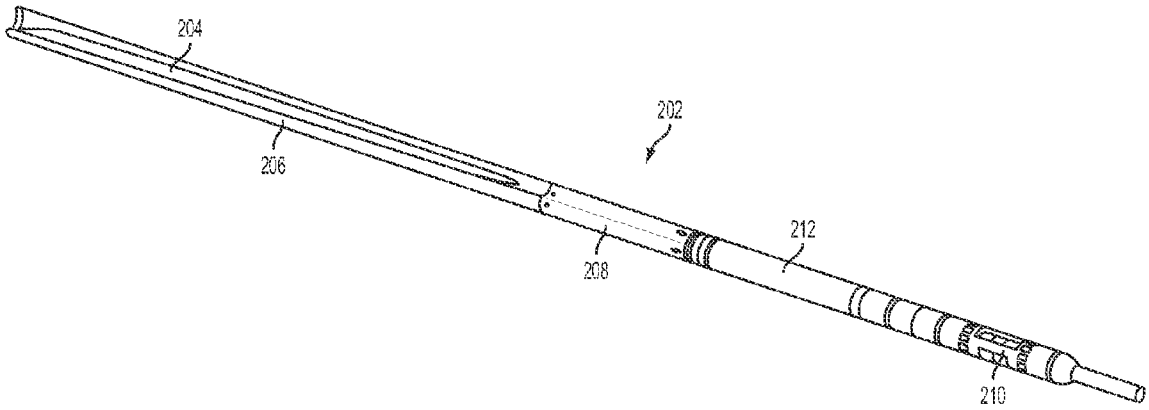
FIG. 2 is a perspective view of an assembly according to one embodiment of the present invention.

Assemblies according to various embodiments of the present invention can be in any desirable configuration to support branch wellbore creation and completion. FIG. 2 depicts an assembly 202 according to one embodiment of the present invention that is capable of deflecting one or more cutting tools and is capable of deflecting a component that is used to complete a branch wellbore. Examples of such completion components include a junction and a screen.

The assembly 202 includes a surface 204 on an outer wall of a body 206. The surface 204 can be capable of deflecting a cutting tool and capable of deflecting a completion component, such as a junction. For example, the surface can be both a whipstock surface and a completion deflector surface. In some embodiments, one portion of the surface 204 is capable of deflecting a cutting tool and another portion of the surface 204 is capable of deflecting a completion component. In other embodiments, the entire surface 204 is capable of deflecting a cutting tool and a completion component.

The body 206 is coupled to a running tool housing 208. The running tool housing 208 is coupled to a latch member 210 through a body portion 212. The latch member 210 can be configured to couple to other components of a tubing string or a casing string. For example, the latch member 210 may be received at an anchor previously installed and oriented, or that is installed with the assembly 202.

The running tool housing 208 can include a receptacle for receiving a running tool that allows the assembly 202 to be run into the wellbore, oriented, and landed. The running tool housing 208 can also include sealing mechanisms.

Figure 3:
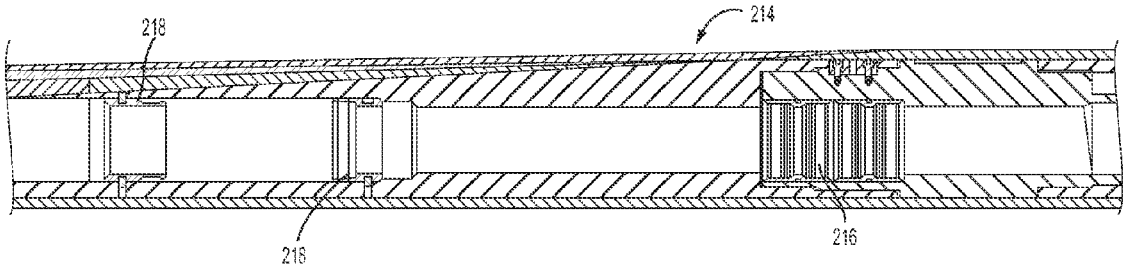
FIG. 3 is a partial cross-sectional view of part of the assembly of FIG. 2 according to one embodiment of the present invention.
Figure 4:
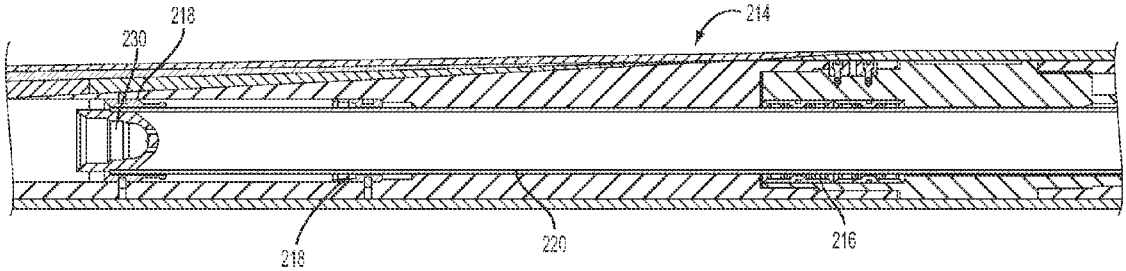
FIG. 4 is a cross-sectional view of part of the assembly of FIG. 2 according to one embodiment of the present invention.

For example, FIGS. 3-4 depict cross-sectional views of an assembly portion 214 that includes sealing members 216 and shear rings 218. The sealing members 216 can be configured to create a pressure barrier between an environment below seals and an environment above the seals to facilitate hydrocarbon production flow from below the seals through a stinger, instead of through an annulus between the stinger and an inner diameter of a completion deflector. The sealing members 216 can create a pressure barrier by providing a pressure seal between an outer diameter of the stinger and the inner diameter of the completion deflector. Debris management components can be provided that prevent debris and other materials from contacting the sealing members 216.

The inner diameter of the completion deflector can define a channel that can receive a seal stinger of a completion component. A liner 220 can be provided that can protect the sealing members 216 and shear rings 218, such as a shearable no-go ring and a shearable no-go ring catcher, from debris. In some embodiments, the liner 220 is a sleeve made from a suitable material such as steel. The liner 220 includes a coupling component, such as collets or a snap ring, that are capable of retaining, such as by cooperating with a collet profile, a position of the liner 220 subsequent to completion component positioning. A running tool, such a hydraulic or mechanical running tool, can be included with the liner 220 to protect sealing members 216 further from debris and the completion component, when for example a running tool is in the completion deflector (e.g. when it is being tripped in the hole). The running tool may be a separate tool that is capable of being used to lower the completion deflector into the well. After the completion deflector is landed at the proper depth and location, the running tool can be released and removed from the well. For example, the running tool can be releasably coupled to the completion deflector by a hydraulic running tool receptacle, or other similar component.

The assembly portion 214 includes a temporary plugging subsystem, such as frangible plug 230, that can prevent debris from entering the inner diameter of the completion deflector prior to a completion component being received and can be breakable by the completion component. The frangible plug 230 can be made from any suitable material. An example of a suitable material is ceramic.

Figure 5:
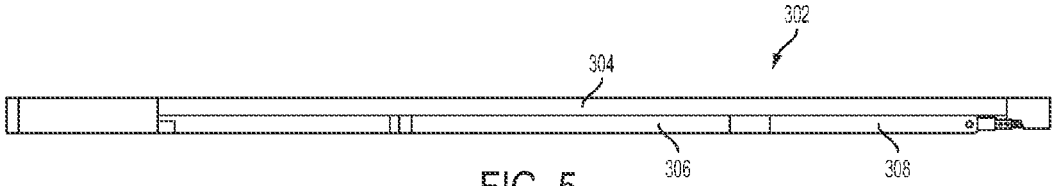
FIG. 5 is a side view of a completion component that is a junction according to one embodiment of the present invention.

FIG. 5 depicts an example of a completion component according to one embodiment. The completion component in FIG. 5 is a junction 302. The junction 302 includes a lateral leg 304 and a stinger 308. The stinger 308 can be a seal stinger. The lateral leg 304 can be deflected by a surface of an assembly toward a branch wellbore. The stinger 308 can be received by an assembly. A breaker, such as a frangible plug breaker, included in the junction 302 can penetrate frangible plug 230 to allow the stinger 308 to be received by the assembly. In some embodiments, the junction 302 may be similar to other junctions, but the stinger 308 and the lateral leg 304 are extended by, for example, fifteen feet.

Figure 6A:
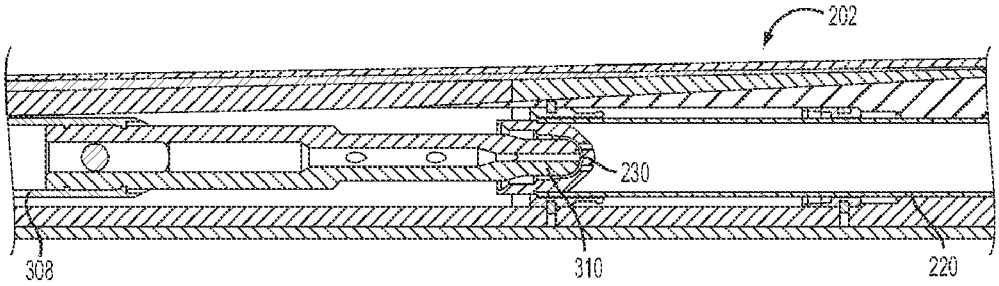
FIG. 6A is a cross-sectional view of an assembly receiving a stinger of a junction according to one embodiment of the present invention.
Figure 6B:
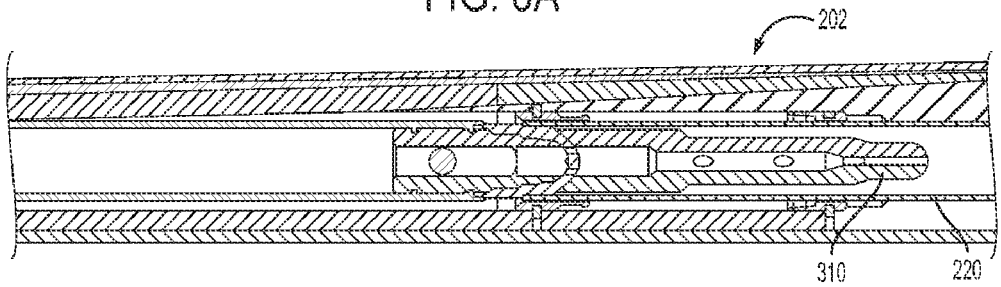
FIG. 6B is a cross-sectional view of the stinger penetrating a subsystem of the assembly in FIG. 6A according to one embodiment of the present invention.
Figure 6C:
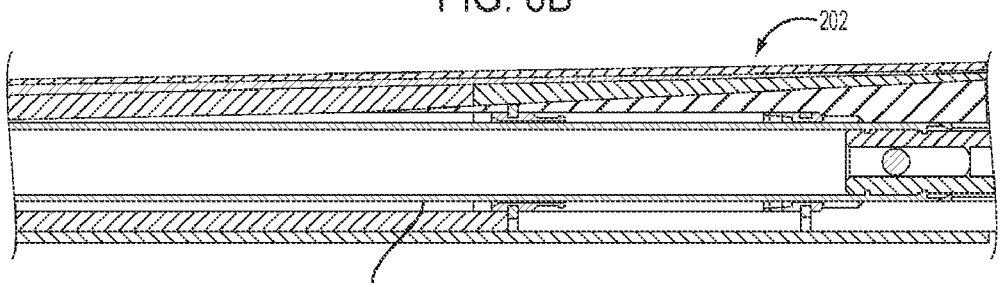
FIG. 6C is a cross-sectional view of the stinger of the junction received by the assembly in FIG. 6A according to one embodiment of the present invention.

FIGS. 6A-6C depict the stinger 308 of the junction 302 penetrating the assembly 202 according to one embodiment of the present invention. FIG. 6A depicts a breaker 310 at the frangible plug 230 of the assembly 202. The breaker 310 can be attached to a running tool, such as a liner hanger running tool that sets a liner hanger above the junction, and can be removed from the bore along with the running tool. The breaker 310 can break the frangible plug 230 and be received in the liner 220 as in FIG. 6B. The liner 220 can protect completion deflector seals from being damaged by debris or otherwise. The stinger 308 can be retained in FIG. 6C while the lateral leg 304 (not shown in FIGS. 6A-6C), is deflected toward a lateral bore. The stinger 308 can be configured to push the liner down.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly configured for being disposed in a wellbore, the assembly comprising:

a surface on an outer wall of a body, the surface being configured for diverting a cutting tool for forming a branch wellbore and for diverting at least part of a completion component toward the branch wellbore, the at least part of the completion component being a junction usable to complete the branch wellbore, the junction comprising a stinger and a lateral leg;

a temporary plugging subsystem between the surface and a channel configured for receiving the stinger; and a liner secured to the temporary plugging subsystem and configured for being displaced by the stinger, the liner being configured to prevent at least some debris from contacting a sealing member, wherein the surface is configured for receiving the stinger and for diverting the lateral leg toward the branch wellbore.

2. The assembly of claim 1, wherein the surface on the outer wall is a whipstock deflection surface and a completion deflector surface.

3. The assembly of claim 1, wherein the temporary plugging subsystem comprises at least one of:

a frangible plug;

a removable plug;

a frangible flapper valve;

a flapper valve;

a removable screen; or a diaphragm.

4. The assembly of claim 1, wherein the liner comprises a coupling component configured for securing the liner at a first position and, responsive to a force from the stinger, for securing the liner at a second position.

5. The assembly of claim 4, wherein the coupling component is configured for releasably securing the liner at the second position, the coupling component comprising at least one of:

at least one collet configured for cooperating with a collet profile; or a snap ring.

6. The assembly of claim 1, further comprising a latch member coupled to the body through a body portion, the latch member being configured to couple to another component disposed in the wellbore.

7. The assembly of claim 1, wherein the surface is configured for diverting the cutting tool and for diverting at least part of the completion component without requiring part of the assembly to be removed from the wellbore prior to diverting the at least part of the completion component.

8. A method for forming and completing a branch wellbore, the method comprising:

disposing an assembly in a parent wellbore, the assembly comprising a surface on an outer wall of the assembly;

moving a cutting tool to the surface on the outer wall of the assembly, wherein the surface on the outer wall of the assembly deflects the cutting tool toward a sidewall of a casing string, wherein the cutting tool forms the branch wellbore after being deflected toward the sidewall of the casing string;

removing the cutting tool from the branch wellbore without removing the assembly; and moving a completion component to the surface on the outer wall of the assembly, the completion component being a junction that is used to complete the branch wellbore, the junction comprising a stinger and a lateral leg, wherein moving the completion component to the surface on the outer wall of the assembly comprises:

moving the junction to cause the surface to deflect the lateral leg toward the branch wellbore and to cause the assembly to receive the stinger, moving the junction to cause a breaker associated with the stinger to break a temporary plugging subsystem of the assembly and to be received by an inner diameter of a liner that is secured to temporary plugging subsystem, wherein the stinger is received by an inner diameter of the assembly and displaces at least part of the liner configured to protect at least one component from debris.

9. The method of claim 8, further comprising:

completing the branch wellbore without removing from the parent wellbore the surface on the outer wall of the assembly for deflecting the cutting tool.

10. An assembly configured for being disposed in a wellbore, the assembly comprising:

a body having a surface that is configured for diverting a cutting tool toward a sidewall of a casing string and is configured for diverting at least part of a completion component toward a branch wellbore, the cutting tool being configured for creating the branch wellbore, the completion component being a junction usable to complete the branch wellbore, the junction comprising a stinger and a lateral leg, wherein the surface is configured for receiving the stinger and for diverting the lateral leg toward the branch wellbore;

a liner secured to a temporary plugging subsystem and to protect at least one component from debris and configured to be displaced by at least part of the completion component; and the temporary plugging subsystem between the surface, wherein the temporary plugging subsystem is breakable by a breaker associated with the stinger, wherein the liner is configured to prevent at least some debris from contacting a sealing member.

11. The assembly of claim 10, wherein the surface is a whipstock deflection surface and a completion deflector surface.

12. The assembly of claim 10, wherein a first portion of the surface is a whipstock deflection surface and a second portion of the surface is a completion deflector surface.

13. The assembly of claim 10, wherein the liner comprises a coupling component configured for securing the liner at a first position and, responsive to a force from the stinger, securing the liner at a second position.

14. The assembly of claim 10, wherein the surface is configured for diverting the cutting tool and for diverting at least part of the completion component without requiring part of the assembly to be removed from the wellbore prior to the at least part of the completion component being diverted.

* * * * *